US007225478B2

(12) United States Patent
Lim et al.

(10) Patent No.: US 7,225,478 B2
(45) Date of Patent: Jun. 5, 2007

(54) ELECTRONIC TOILET AND FLUSHING SYSTEM

(75) Inventors: Chang Shik Lim, Sangju-Si (KR); Hee-Seok Chang, #101-1508 Hansol Apt., Samsung-Dong 4-6, Gangnam-Gu, Seoul 135-091 (KR)

(73) Assignee: Hee-Seok Chang, Seoul (KR)

( * ) Notice: Subject to any disclaimer, the term of this patent is extended or adjusted under 35 U.S.C. 154(b) by 331 days.

(21) Appl. No.: 10/526,426

(22) PCT Filed: Aug. 22, 2003

(86) PCT No.: PCT/KR03/01694

§ 371 (c)(1),
(2), (4) Date: Mar. 2, 2005

(87) PCT Pub. No.: WO2004/022861

PCT Pub. Date: Mar. 18, 2004

(65) Prior Publication Data

US 2005/0283891 A1 Dec. 29, 2005

(30) Foreign Application Priority Data

Sep. 4, 2002 (KR) ..... 10-2002-0053231

(51) Int. Cl.
*E03D 1/00* (2006.01)

(52) U.S. Cl. ..... 4/313; 4/407

(58) Field of Classification Search ..... 4/313, 4/324, 325, 406, 407, DIG. 3
See application file for complete search history.

(56) References Cited

U.S. PATENT DOCUMENTS 2,744,262 A * 5/1956 Boyd ..... 4/407
5,228,146 A * 7/1993 Martell ..... 4/406

* cited by examiner

*Primary Examiner*—Justine R. Yu
*Assistant Examiner*—Huyen Le
(74) *Attorney, Agent, or Firm*—GWiPS

(57) ABSTRACT

A functional electronic toilet and flushing system capable of controlling the amount of flushing water according to the sensed occupancy time compared with predefined normal time durations for urination and bowel movement, in order to use an optimum amount of flushing water and to protect an occupant by detecting the sitting attitude or position. To perform these functions, this electronic toilet and flushing system comprises a sensor unit attached at the exterior of the toilet bowl for detecting a toilet user, a control unit for issuing a control signal indicating either urine or stool by comparing the occupancy time with the predefined normal time duration, an air bubble generator for generating air bubbles according to the control signal from the above control unit indicating the nature of the toilet's contents; a solenoid valve connected to the air bubble generator for controlling the supply of air bubbles; a float for floating up or sinking down according to the air bubbles supplied by the air bubble generator; and a siphon lid for flushing the toilet water according to the floating position of the float.

4 Claims, 5 Drawing Sheets

ELECTRONIC TOILET AND FLUSHING SYSTEM

TECHNICAL FIELD

The present invention relates to a functional electronic toilet and flushing system for installation in home or public rest rooms. More particularly, it is equipped with a sensing means for detecting occupancy, an air bubble generating and supplying means for filling a float with air, a flushing means for cleaning the bowl depending on a sensed signal of urine or stools by comparing the sensed occupied time with the preset time threshold, and an operating means for opening or closing a siphon lid depending on the floating up or sinking down of the float.

BACKGROUND ART

Generally, a toilet bowl used for both urination and stool consisted of a ceramic bowl as a main body and a flushing water tank as a reservoir disposed at the back of the main body. The conventional toilet bowl adopts the method that a certain amount of water must be filled in the water tank to completely flush out the contents of the toilet bowl.

Recently, an improved automatic toilet system has been introduced for installation in modern public buildings. The automatic toilet bowl adopts the control system, which has an infrared sensor to detect occupancy of the toilet and to transmit the sensed signal to the main control unit for operating a solenoid valve connected to a flushing valve installed in the toilet bowl.

As shown in FIG. 1, another method is introduced for flushing the bowl in which an infrared sensor (1) installed on the cover of the toilet bowl senses occupancy of the toilet and a main control unit (2) for processing the sensed signal and a motor (3) for lifting a siphon cover vertically by means of a connected chain.

The conventional solenoid valve applied to the flushing system requires high water pressure in the water supply line. Therefore, it is possible to use a pilot type of solenoid valve in the public buildings, which is operable in the high water pressure with low power consumption. On the contrary, it is difficult to use a solenoid valve for the common toilet bowl with a back water tank used in residences because the water pressure in the residential water supply line is relatively low.

Especially, a direct-operating type of one-inch diameter solenoid valve is developed and currently produced for installation in residential bathrooms, which has relatively lower water pressure and flow rate. However, this type of valve has a disadvantage in that it takes relatively longer to operate and does not properly dispose of the contents because of the low water pressure and low flow rate.

Further, some conventional toilet bowl employ a motor for forcibly supplying the proper amount of water. However this system has the disadvantage of a complicated linkage mechanism. Because the motor is operated in a damp environment, the durability of the motor is always problem.

DISCLOSURE OF THE INVENTION

An objective of the present invention is to provide a functional electronic toilet bowl comprising a sensor to detect the presence of a user and to transmit the sensed signal to a controller for processing the signal, an air bubble generating and supplying unit to fill the air bladder in a float, and a flushing unit for lifting up a siphon lid by the floating of the buoy.

Another objective of the present invention is to provide a functional electronic toilet bowl comprising a flushing means for cleaning up the bowl depending on a sensed signal of urine or stool by comparing the sensed occupied time with the preset time threshold, and an operating means for opening or closing a siphon lid depending on the floating up or sinking down of the float.

BEST MODE FOR CARRYING OUT THE INVENTION

To achieve the above objectives of the present invention, the functional electronic toilet bowl and flushing system comprises a sensor unit which is attached outside of a toilet bowl for detecting occupancy by a toilet user, a control unit for issuing a control signal of either urine or bowel movement by comparing a certain occupancy time elapsed with a predefined time threshold, an air bubble generator for generating air bubbles according to the issued control signal (urine or stool) from the control unit, a solenoid valve which is connected to the air bubble generator for controlling the supply of air bubbles, a float or buoy for floating up or sinking down according to the air bubbles supplied by the air bubble generator, and a siphon lid for flushing the toilet bowl according to the floating of the buoy.

Also included is a limit bracket for controlling a stroke of the siphon lid and the quantity of flushing water depending on the supplied air bubble generated by the control signal indicating either urine or bowel movement.

A melody chip is provided to output a melody through a speaker for a certain period of time when a user presses a melody button on the control unit, and a home security unit to automatically call a guardian if a user occupies the toilet longer than a certain preset occupancy time limit (for example 30 minutes for stools) after sensing occupancy from the sensing unit through an emergency signal activator.

A solenoid valve is connected in parallel to the air bubble generator through a T-type connector and is further connected to the buoy through a flexible tube. A vent-cock of the solenoid valve is always closed during the supply of the air bubbles to the buoy, and the vent is opened when the air bubbles vent out from the buoy.

Referring to the accompanying drawings, the electronic toilet bowl and flushing system of the present invention with the implementing examples are described in detail below.

However it is understood that the present invention is not limited to the disclosed embodiment.

Figure 1:
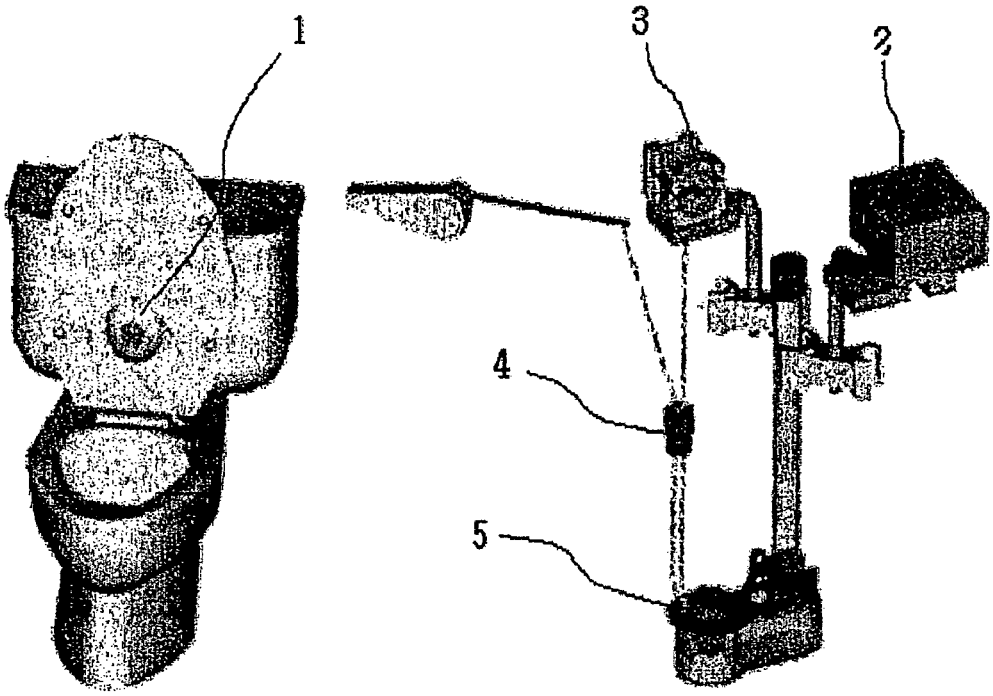
FIG. 1 is a conventional toilet bowl equipped with a conventional mechanism.
Figure 2:
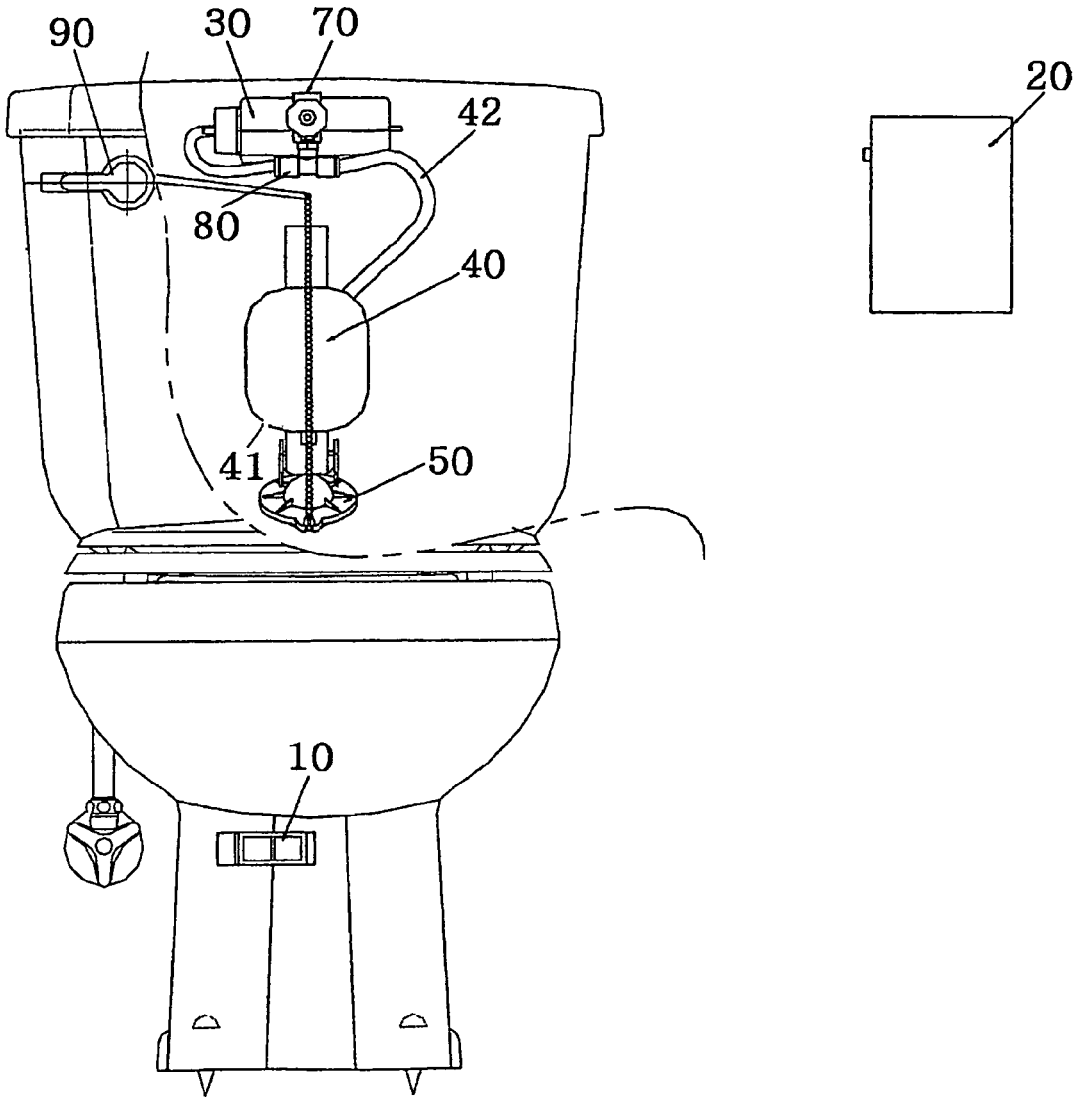
FIG. 2 is a front view of a functional electric toilet and flushing system of the present invention.
Figure 3:
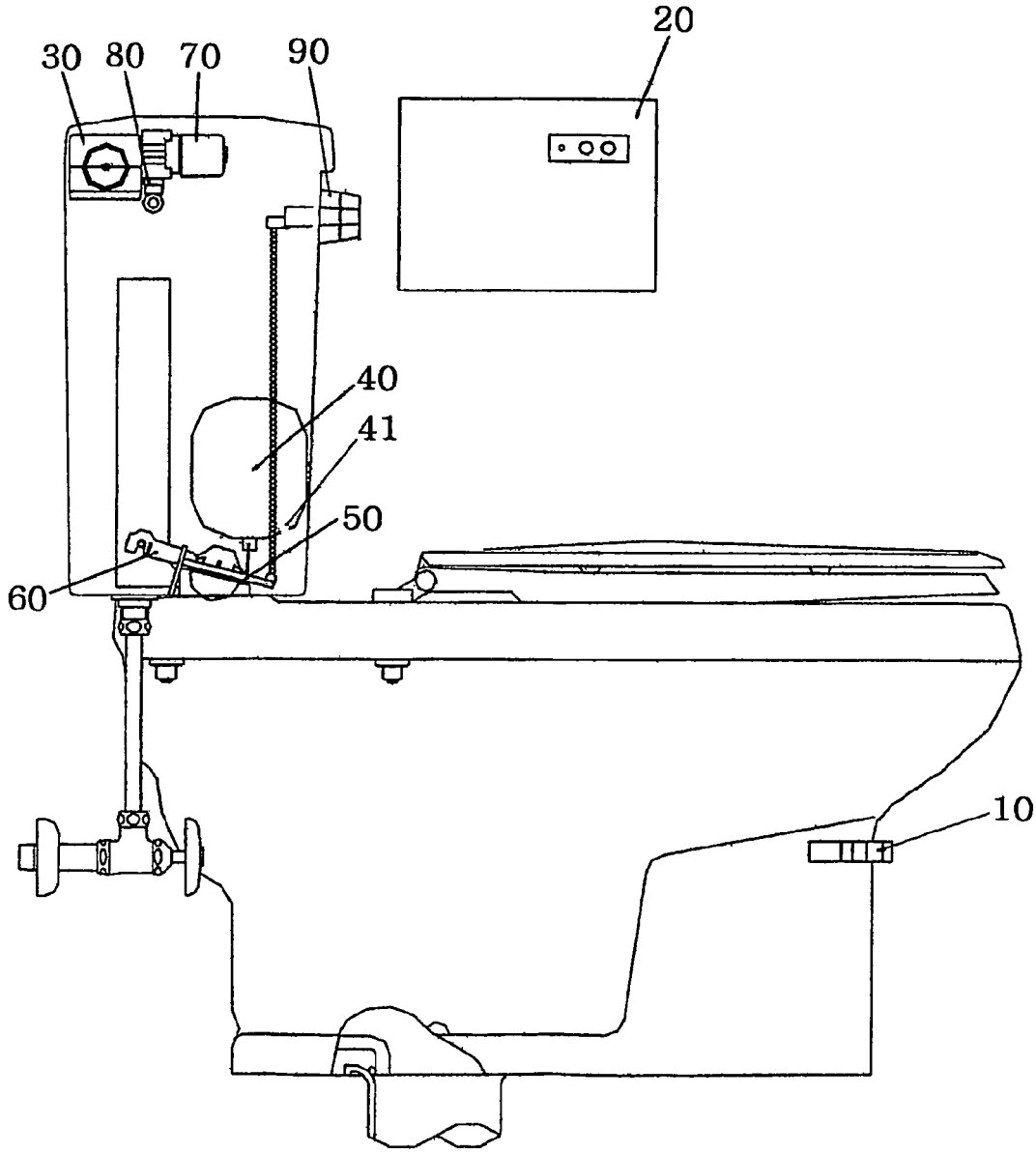
FIG. 3 is a side view of the functional electric toilet and flushing system of the present invention.
Figure 4:
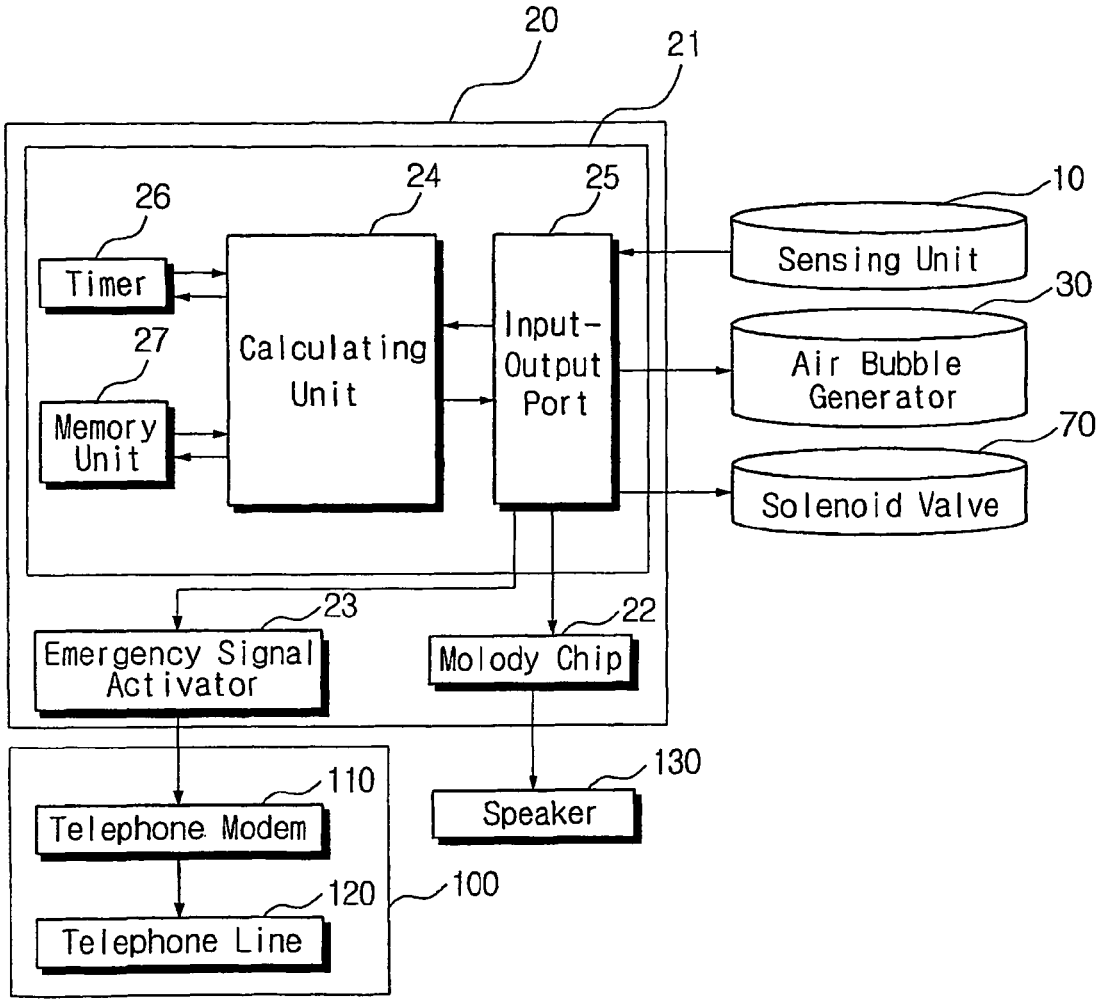
FIG. 4 is a block diagram of the functional electric toilet and flushing system of the present invention.
Figure 5:
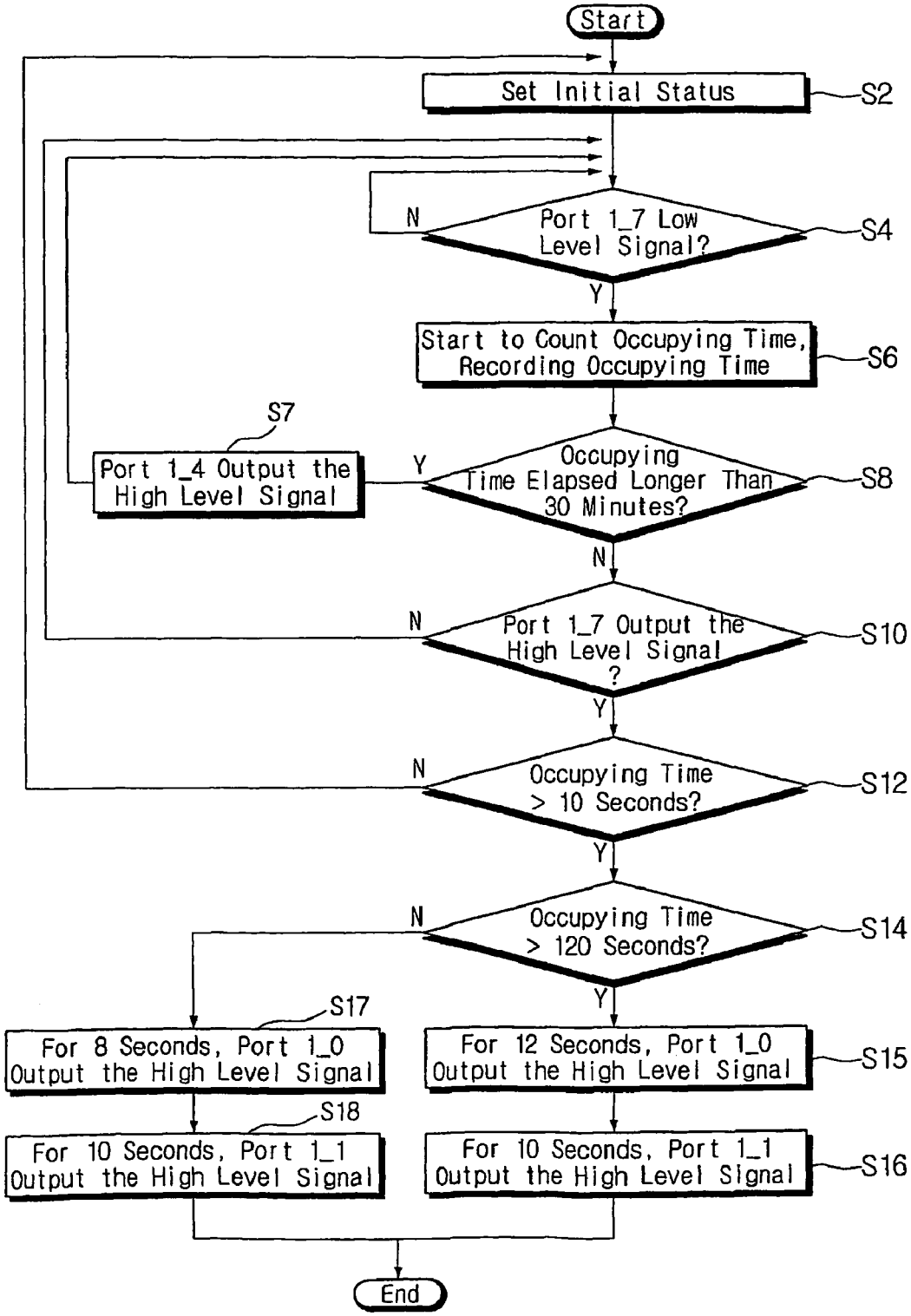
FIG. 5 is a control flow chart of the functional electric toilet and flushing system of the present invention.

FIG. 2 is a front view of a functional electric toilet and flushing system of the present invention, FIG. 3 is a side view of the functional electric toilet and flushing system of the present invention, FIG. 4 is a block diagram of the functional electric toilet and flushing system of the present invention, and FIG. 5 is a control flow chart of the functional electric toilet and flushing system of the present invention.

A functional electric toilet and flushing system of the present invention comprises a sensor unit (10) for detecting occupancy of a toilet user, a control unit (20) for controlling and issuing a control signal indicating either urine or stool by comparing a sensed occupancy time with a predefined normal time duration, an air bubble generator (30) for generating air bubbles according to said control signal indicating the nature of the toilet contents from said control unit (20), a float (40) for floating up or sinking down according to the supplied amount of air bubbles by said air bubble generator (30), a siphon lid (50) for flushing toilet bowl according to floating level of said float (40), and a solenoid valve (70) for controlling the supply of air bubbles.

Referring to FIGS. 2 and 3, the electronic toilet bowl and flushing system is described in detail.

A sensor unit (10) is located in the lower part of a toilet bowl for continuously detecting occupancy by a toilet user.

The sensor utilizes an infrared beam and receives the reflections to detect whether there is an occupant who sits in a normal position. The sensor is also able to detect an abnormal position such as a falling down position on the floor.

When the sensor (10) transmits the detected signals to the control unit (20), it starts to count the occupancy time in order to issue a control signal of either urine or bowel movement by comparing with a predefined time.

As shown in FIG. 4, the control unit (20) consists of a micro-processing unit (21) including a calculating unit (24), an input-output port (25), a timer (26) and a memory unit (27), a melody chip (22) for storing and playing several melodies and an emergency signal activator (23) for making an emergency telephone call. When a user pushes a button, the melody is played for a certain period of time. The emergency signal activator (23) is connected to an emergency phone line for automatically calling to a guardian when the sensor detects the abnormal position of the occupant.

The micro-processing unit (21) is activated when the sensor (10) detects the occupancy of the toilet seat and transmits the signal to the input-output port (25). Then, the timer (26) activates to count the occupancy time in order to issue a control signal of either urine or bowel movement. The memory unit (27) stores the predefined durations for comparing a normal occupancy time with the sensed time.

Then, the calculating unit (24) receives data of the actual occupancy time from the timer (26) and the normal duration from the memory unit (27) to carry out the comparison to determine the nature of the toilet contents. The memory unit (27) stores the pre-sorted time durations for typical human bathroom activities, such as user's occupied, non-occupied, urination, bowel movement or borderline of urination and bowel movement time.

Referring to FIG. 5, the flow chart of the functional electronic toilet and flushing system of the present invention is described in detail. When a user occupies the toilet, the sensor (10) detects the occupancy and transmits the detected signals to the control unit (20). Then, the calculating unit (24) begins to count the elapsed occupancy time. If the elapsed occupancy time is longer than the predefined normal duration (for example 30 minutes), the calculating unit (24) initiates the emergency signal activator (23) to issue an emergency signal to the home security system (100).

The home security system (100) includes a telephone modem (110) to access an emergency phone number, such as 911, a rescue team or a close relative's phone number.

In case a user passes through the toilet and leaves, or someone interrupts the sensor while passing by the toilet without intention to use it, the sensor (10) keeps emitting and detecting the reflected beams to continuously verify occupancy. If the sensor (10) does not detect the occupancy of the toilet for 10 seconds continuously, the calculating unit (24) returns to the initial position to re-set a status of "NO OCCUPANCY".

If the sensor (10) detects the occupancy of the toilet longer than 10 seconds, but less than 120 seconds, the calculating unit (24) judges and issues a control signal of urination. If the sensor (10) detects occupancy of the toilet longer than 120 seconds, the calculating unit (24) judges and issues a control signal of stool.

At this point, the time controls are defined as "occupancy", "no occupancy" or "borderline of urination and BM". However, the time controls are not limited these terminology.

In case a user does not want to hear an urinary noise or simply wished to be in a good mood, the user may press a melody button on the control unit (20). Then, the melody stored in the melody chip (22) is output through a speaker (130) for a certain period of time in order to mask a noise.

An 8-bit, 80C31-chip designed for controlling the micro processing unit (21) is suitable to use in the control unit (20).

The air bubble generator (30) generates the required amount of air bubbles depending on the control signals of urine or stool issued from the control unit (20).

For example, the air bubble generator (30) may operate eight seconds for urination and twelve seconds for stool to generate a certain amount of air bubbles.

The operating time for generating the air bubbles is also adjustable depending on different circumstances.

The solenoid valve (70) is connected in parallel to the air bubble generator (30) through a T-connector (80) and is further connected to the float or buoy (40) through a flexible tube (42). The air bubbles generated by the air bubble generator (30) pass through the T-connector to the float (40). At this point, a vent-cock at the solenoid valve (70) is always closed (N.C.) during the supply of the air bubbles to the buoy (40). When the solenoid valve (70) is signaled by the control unit (20) to discharge the air bubble, the vent-cock is opened to discharge the air bubbles from the float (40).

The top end of the float or buoy (40) is connected to the flexible tube (42), and an inlet-outlet opening (41) is formed in the bottom end of the float or buoy (40).

Under ordinary conditions, the float or buoy (40) is filled with water to sink down. When the air bubble is supplied from the air bubble generator (30), the water in the float is discharged through the inlet-outlet opening (41) as the air fills the buoy, causing the buoy to float up depending on the amount of supplied air.

When the vent-cock of the solenoid valve (70) is opened, the water fills the float through the inlet-outlet opening (41) to sink down the buoy (40).

The siphon lid (50) is connected to the float or buoy (40) for controlling the amount of flushing water depending on the control signal.

Furthermore, the siphon lid (50) is connected to a limit bracket (60) for controlling the length of the opening stroke of the siphon lid (50) and the quantity of flushing water depending on the issued control signal of either urine or stool.

In addition, the siphon lid (50) is connected to the conventional lever (90) for manual flushing in an emergency situation.

Referring to FIGS. 4 and 5, the operating process of the electronic toilet bowl and flushing system as in the implementing example is described in detail.

At step 2, the input-output port (25) and the timer (26) of the micro-processing unit (21) are set to their initial status. At step 4, the micro-processing unit (21) verifies whether a low level signal is transmitted to port 1_7, which is activated by the sensor when a user approaches to occupy the toilet.

Next, at step 6, the timer (26) in the micro-processing unit (21) begins to count the time duration of the continuous low level signal. The sensed time is recorded and compared to the memory unit (27) in real time. At step 8, if the sensed occupancy duration is longer than the predefined normal time duration (for example 30 minutes), the micro-processing unit (21) judges the user to be in an emergency situation. At step 7, the home security system (100) including a telephone modem (110) initiates the emergency signal activator (23) to issue an emergency signal to the home security system (100), such as 911, rescue team or close relative's phone number.

On the other hand, the memory unit (27) in the micro-processing unit (21) records the sensed real time until the sensing unit (10) receives the continuous high level signal.

At step 10, the calculation unit (24) in the micro-processing unit (21) recognizes the continuous high level signal. At step 12, the calculating unit (24) reads in the data stored in the memory unit (27) to compare to the sensed data. In case a user passes through the toilet and leaves, or someone interrupts the sensor while passing by the toilet without intention to use it, the sensor (10) keeps emitting and detecting the reflected beams to continuously verify occupancy. If the sensor (10) does not detect the occupancy of the toilet for 10 seconds continuously, the calculating unit (24) returns to the initial position to re-set a status of "NO OCCUPANCY".

At step 14, if the sensor (10) detects occupancy of the toilet longer than 10 seconds, but less than 120 seconds, the calculating unit (24) judges and issues a control signal of urination. If the sensor (10) detects the occupancy of the toilet longer than 120 seconds, the calculating unit (24) judges and issues a control signal of stool. Then, the air bubble generator (30) begins to supply the air bubble to the float through port 1_0.

At step 15, the air bubble generator (30) generates the required air bubbles for 12 seconds depending on the control signal of stool issued by the micro-processing unit (21) through port 1_0. At step 16, the solenoid valve (70) is turned on for 10 seconds through port 1_1. At step 17, the air bubble generator (30) generates the required air bubbles for 8 seconds depending on the control signal of urine issued by the micro-processing unit (21) through port 1_0. At step 18, the solenoid valve (70) is turned on for 10 seconds through port 1_1.

The solenoid valve (70) is connected parallel to the air bubble generator (30) through a T-connector (80) and is further connected to the float (40) through a flexible tube (42). The air bubbles generated by the air bubble generator (30) are supplied to the float (40) via the T-connector (80). At this point, if a vent-cock of the solenoid valve (70) is in closed status (N.C.) during the supply of the air bubbles, the buoy (40) starts floating.

In the toilet water tank, a certain level of water is always maintained. The float (40) connected to the flexible tube (42) has an inlet-outlet opening (41) at the bottom. The float (40) filled with water starts to float when the air bubble generator (30) supplies the air bubble to discharge the water through the inlet-outlet opening (41).

The float (40) is connected to the siphon lid (50) for controlling the flushing water depending on the control signal. Further, the siphon lid (50) is connected to a limit bracket (60) for controlling the length of the opening stroke of the siphon lid (50) and the quantity of flushing water depending on the issued control signal of either urine or stool.

On the other hand, the amount of flushing water is controlled depending on the amount of air filling the float. The air bubble generator (30) supplies the air bubbles to fill the float (40) by operating for 8 seconds for urination and 12 seconds for stool.

The micro-processing unit (21) controls the solenoid valve (70) to flush away the contents of the bowl for 10 seconds for urination and stool through port 1_1. At this point, the air in the float is vented through the vent-cock of the solenoid valve (70).

At the same time, the float (40) is filled with supplied water (30) through the inlet-outlet opening (41) when the air bubble is vented. Then, the siphon lid (50) is closed due to the increase of water pressure in the water tank and lower position of the float (40).

The water supply is automatically stopped when the water level reaches the preset position.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

INDUSTRIAL APPLICABILITY

As discussed so far, this invention has an effect that the electronic toilet detects the user, controls the position of the float by supplying the proper amount of air bubbles from the air bubble generator and automatically flushes the toilet bowl depending on the sensed signal of urine or stool.

This invention has another effect that it is possible to reduce overuse of water by controlling the amount of flushing water according to the sensed occupancy time compared with the predefined normal duration to use an optimum amount of water.

It also has an effect that this invention is able to protect the user by detecting the sitting attitudes or positions of the occupant. If the occupancy time is longer than the predefined normal duration or the sensor detects the abnormal position of occupant, this toilet system automatically transmits an emergency signal to the rescue team or a close relative.

The invention claimed is:

1. A functional electronic toilet and flushing system that comprises:

a sensor unit (10) attached to the exterior of a toilet bowl for detecting occupancy of a toilet user, a control unit (20) for controlling and issuing a control signal indicating either urine or stool by comparing a sensed occupancy time with a predefined normal time duration, an air bubble generator (30) for generating air bubbles according to said control signal indicating the nature of the toilet contents from said control unit (20), a solenoid valve (70) connected to said air bubble generator (30) for controlling the supply of air bubbles, a float (40) for floating up or sinking down according to the supplied amount of air bubbles by said air bubble generator (30), and a siphon lid (50) connected to said float (40) for flushing toilet bowl according to floating level of said float (40).

2. A functional electronic toilet and flushing system as claimed in claim 1 that further comprises a limit bracket (60) for controlling the stroke length of said siphon lid (50) and the quantity of flushing water depending on the supplied air bubble and the issued control signal indicating either urine or stool.

3. A functional electronic toilet and flushing system as claimed in claim 1 that further comprises:

a melody chip (22) to output a melody through a speaker (130) for a certain period of time when a user presses a melody button on said control unit (20), and a home security unit (100) for automatically transmitting an emergency signal to a rescue team or guardian when a user occupies the toilet longer than a preset normal time duration after initiating occupancy time counts from said control unit (20) through an emergency signal activator (23).

4. A functional electronic toilet and flushing system as claimed in claim 1, wherein said solenoid valve (70) is connected in parallel to said air bubble generator (30) and said float (40) through a T type connector (80) and a flexible tube (42), and a vent-cock of said solenoid valve (70) is always closed during the process of supplying the air bubbles to said float (40), and said vent-cock is opened when the air bubbles are vented from said float (40).

* * * * *